United States Patent [19]

Fontana

[11] Patent Number: 4,545,094

[45] Date of Patent: Oct. 8, 1985

[54] EXTENSIBLE CLASP FOR USE WITH FLEXIBLE WRISTLET

[75] Inventor: Fernando Fontana, Sesto Calende, Italy

[73] Assignee: Omega SA, Bienne, Switzerland

[21] Appl. No.: 608,337

[22] Filed: May 9, 1984

[30] Foreign Application Priority Data

May 13, 1983 [IT] Italy ..... 21091 A/83

[51] Int. Cl.[4] ..... A44C 5/24

[52] U.S. Cl. ..... 24/71 J; 24/70 J; 24/265 WS; 24/585

[58] Field of Search ..... 24/71 J, 70 J, 265 WS, 24/116 A, 336, 585, 616, 618, 644, 238, 273

[56] References Cited

U.S. PATENT DOCUMENTS

| | | | |
|---|---|---|---|
| 857,197 | 6/1907 | Patterson | 24/273 |
| 1,673,117 | 6/1928 | Kestenman | 24/71 J |
| 1,768,868 | 7/1930 | Tost | 24/71 J |
| 1,966,063 | 7/1934 | Domler | 24/71 J |
| 2,500,649 | 3/1950 | Szeglin | 24/71 J |
| 2,738,561 | 3/1956 | Trilling et al. | 24/585 |
| 3,521,331 | 7/1970 | Gay | 24/71 J |
| 3,550,216 | 12/1970 | Gandelman | 24/71 J |
| 3,696,469 | 10/1972 | Kalinsky | 24/71 J |
| 3,863,299 | 2/1975 | Hocq | 24/71 J |

FOREIGN PATENT DOCUMENTS

| | | | |
|---|---|---|---|
| 1100923 | 9/1955 | France | 24/585 |
| 21184 | 4/1981 | Italy . | |
| 352175 | 3/1961 | Switzerland | 24/585 |
| 568035 | 10/1975 | Switzerland . | |
| 234990 | 6/1925 | United Kingdom | 24/71 J |

*Primary Examiner*—Victor N. Sakran

*Attorney, Agent, or Firm*—Griffin, Branigan & Butler

[57] ABSTRACT

An extensible clasp is described for use with a continuous flexible wristlet, as for a watch. The clasp comprises first and second elongated portions that are connected by a hinge pin. The first portion is slightly curved to conform to the shape of a wrist and is formed of two parts that can slide along each other, with one part carrying the hinge pin at one end and being formed with a single hole near its other end, and the other part being formed with several aligned holes arranged selectively to register with the single hole. The second portion is also curved, but slightly more so, and carries a beak element which, upon the two portions being folded over each other to close the clasp, is pushed through a registering pair of holes to lock the clasp in a selected position. To open the clasp, pressure is exerted in the region of the middle of the second portion and/or a flap, pivotally mounted on the second portion at its free end but restrained from pivoting backwards beyond a certain point, is pulled upwards to ease the beak element out of the registering holes by a camming action.

8 Claims, 6 Drawing Figures

EXTENSIBLE CLASP FOR USE WITH FLEXIBLE WRISTLET

BACKGROUND OF THE INVENTION

1. Field of the Invention

This invention relates to an extensible clasp for use with a flexible wristlet, e.g. a bracelet, as for a watch.

Wristlets, particularly those of watches, should be easily closable and not be liable to slip away when forming the loop round a wrist.

For this reason, a wristlet should preferably be continuous as it cannot then slip off the wrist. The length of the wristlet must then be variable to enable it first to be slipped over the hand and then shortened to fit snugly round the wrist.

2. Prior Art

One known bracelet construction consists of contiguous metal segments that contain small springs enabling the bracelet to lengthen when pulled. For this the springs must be very small with the result that they are over exerted and short lived.

To remedy this, hinged clasps have been proposed for use with a metal bracelet comprising a pair of flexible but inextensible portions. In this improved continuous arrangement, the clasp comprises rigid, hingedly connected, portions that can be folded over each other. A great many such clasps have been designed. One such clasp comprises three rigid portions with the first folding under the second whilst the third, acting as a cover, engages over the second and locks on the first.

One notable improvement was achieved with the clasp disclosed in Swiss Patent Specification No. 568035, which combines improved aesthetics with improved ease of closure and safety.

This clasp is made up of two non deformable portions hinged to each other, in which the second portion is wholly covered by a part of the flexible bracelet whilst both segments overlie each other in the closed position. When closed, the bracelet appears to have a continuous line except for a plate which hides a lateral locking device.

The bracelet is elegant, the two folded portions of the clasp are invisible and the closing action is and looks reliable. However, between the open and closed positions of the bracelet, the difference in bracelet length is limited, particularly so when the clasp is made up of short portions as is usual for small, women's wrists.

Other designers have proposed bracelets with clasps that again comprise two rigid portions but in which, at the end of one portion, an elastic hinge arrangement, involving spring means, is provided within the thickness of the bracelet. Such a construction is detrimental to both the trustworthiness and the aesthetics of the bracelet.

The specification of Italian Patent Application No. 21184A/81 discloses an extensible bracelet fitted with a clasp having two portions of which one is made up of two parts that slide one within the other. Small springs are provided to return the two parts into a contracted position and means are provided for securing them together in that position. The clasp is thus extensible and reliable but still suffers from two drawbacks: the small springs are soon subject to fatigue and the two sliding parts continuously tend to move to their contracted position, already when slipping the bracelet over a hand. Further, the scope for adjustment is small.

SUMMARY OF THE INVENTION

An object of the invention is to provide a bracelet clasp that does not suffer from the above mentioned drawbacks.

More particularly, an object of the invention is to provide a neat-looking clasp for a flexible wristlet, in particular a flexible bracelet, which is extensible, which is adjustable to the size of a wrist, including small wrists, e.g. women's wrists, and which can easily and safely be operated.

According to the invention there is provided an extensible clasp for use with a flexible wristlet, comprising first and second elongated portions, hinge means for connecting to each other one end of said portions and means at the opposite end of said portions for pivotally connecting said portions to portions of said wristlet, said first portion being provided near its opposite end with a projecting locking element having a transverse recess therein and said second portion having first and second parts mounted for longitudinal sliding motion one relatively to the other, said first part being connected to said first portion by said hinge means and being formed with a hole at a distance from said hinge means substantially equal to the distance separating said hinge means from the locking element, and said second part being formed along the length thereof with a plurality of holes each able selectively to be brought into alignment with the hole in said first part by relative sliding motion of said first and second parts to enable the locking element to extend therethrough upon closure of the clasp, said recess being engageable with an edge portion of the hole through which it extends in said second part to lock the clasp once closed.

Thus, by slidably moving in or out the two parts of the second clasp portion, the single hole can be brought into register with any one of the plurality of holes to produce a corresponding plurality of wristlet lengths, each of which may be arrived at easily and safely with the help of the locking element which locks the two parts to each other and closes the clasp in a simple and easy manner.

The clasp preferably comprises a flap pivotally mounted at the opposite end of the first clasp portion for bridging the region of the clasp, when closed, between the means provided at the opposite end of the first and second clasp portions and for facilitating the opening of the clasp.

DETAILED DESCRIPTION

Figure 1:
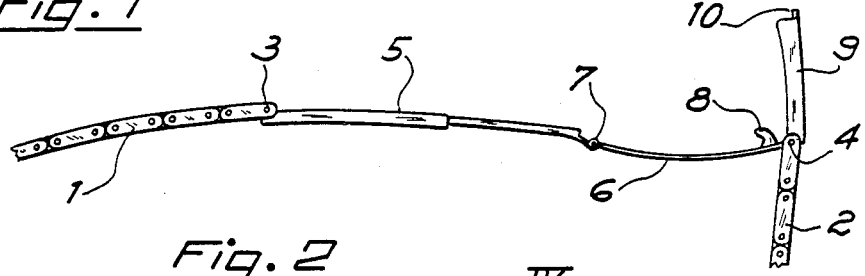
FIG. 1 is a side view of an extensible clasp embodying the invention, along with adjacent portions of a flexible watch-bracelet to which it is connected, the clasp being shown in a fully extended position.

The arrangement shown in the drawings comprises two bracelet portions 1 and 2, each consisting of metal links, that are connected at one end (not shown) to an object such as a watch, and at the other end, by means of hinge pins 3 and 4, to the opposite ends of an extensible metal clasp having a rigid elongated portion 5 and a resilient semirigid elongated portion 6 connected to each other by a hinge pin 7, to form a continuous loop. Portion 5 is slightly curved to conform to the shape of a wrist. Portion 6 is also curved, but slightly more so, and carries on its concave side, near pin 4, a beak element 8.

Figure 5:
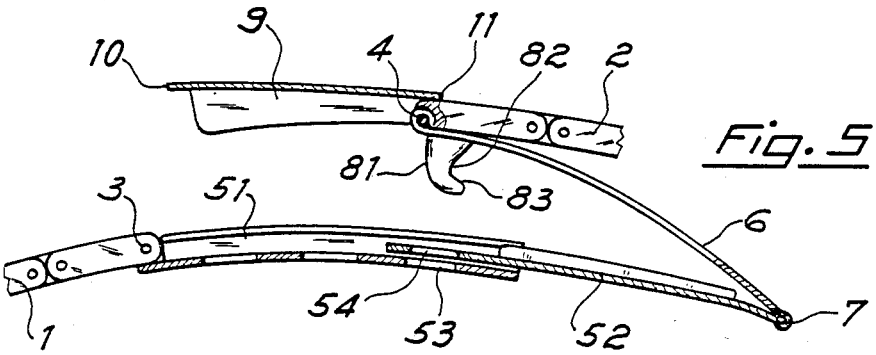
FIG. 5 is a side view on an enlarged scale of the clasp shown in FIGS. 1 to 4 in a position shortly before reaching its closed and locked position, the clasp being here shown in longitudinal section.
Figure 6:
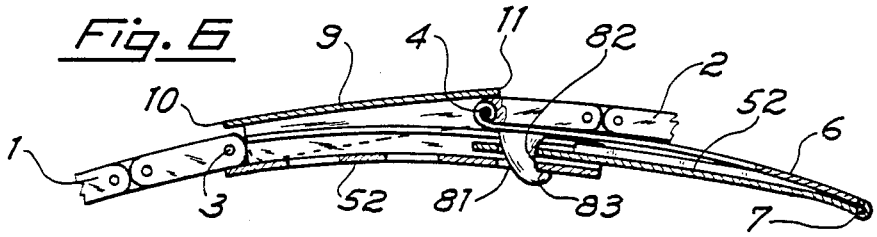
FIG. 6 is a side view on an enlarged scale also of the clasp shown in FIGS. 1 to 4 in its closed and locked position, the clasp being here again shown in longitudinal section.

As shown in FIGS. 5 and 6, beak element 8 has, to one side, a ridge 81 that curves towards pin 7 and defines, along the other or inner side, a transverse recess 82 behind a hooked tip 83 directed towards pin 7. Beak element 8 and hole 54 are so positioned that hooked tip 83 will abut against the inward edge of hole 54 when clasp portion 6 is folded over on to clasp portion 5. Recess 82 has a surface to the side of tip 83 that diverges from part 52 adjacent element 8.

Portion 5 is formed of two parts 51 and 52 mounted for longitudinal sliding movement one along the other while remaining rigid as a whole, part 51 having folded inturned edges that overlap and engage unfolded edges along one end of part 52, the remainder of the longitudinal edges of part 52 being flanged so as to cooperate with the inturned edges of part 51 to provide longitudinal guidance for parts 51 and 52 during sliding.

Figure 2:
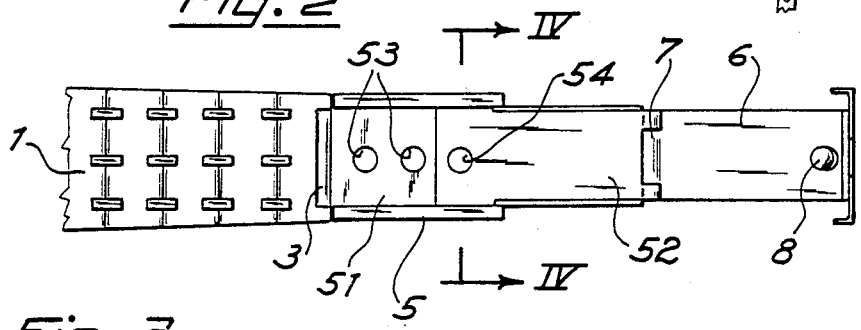
FIG. 2 is a plan view of the assembly shown in FIG. 1.
Figure 3:
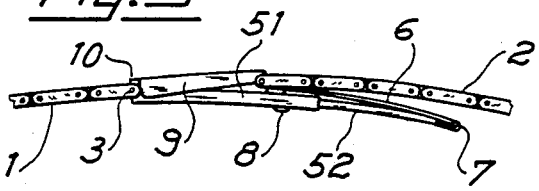
FIG. 3 is again a side view of the assembly shown in FIG. 1, but showing the clasp in a closed and locked position.
Figure 4:
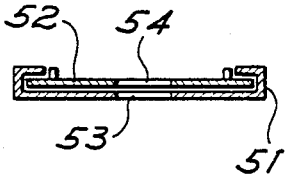
FIG. 4 is a cross-section along line IV—IV of FIG. 2.

Part 51, which carries pin 3, is formed therealong with a plurality (here three) of equidistant holes 53 while part 52, which carries pin 7, is formed with a single hole, 54, near the end thereof remote from pin 7. In FIG. 2 hole 54 is shown coinciding with the third of holes 53. In this position the clasp can be locked in a position of maximum extension.

To close and lock the clasp, portion 6 is folded over on to portion 5 and at the same time part 52 of portion 5 is made to slide along part 51, with the help of a flap 9 flanged along opposite sides and pivotally mounted on pin 4, until the bracelet fits snugly round the wrist. At this point, pressure is exerted in the region of the second link of bracelet portion 2 to compress the central region of curved portion 6. Portion 6 is hence straightened thereby increasing the distance between pin 7 and beak element 8 by an amount such that beak element 8 can be urged through hole 54 and the nearest hole 53 that will coincide with hole 54 in the snug wrist-fit position of the bracelet to lock the clasp in this position, some to and fro sliding movement between flap 9 and part 51 being effected to bring hole 54 into alignment with the nearest hole 53.

On releasing the clasp, firstly the wrist will distend and cause part 51 to move further to the left and hole 53 to engage with recess 82 behind tip 83, and secondly clasp portion 6 resumes its normal curved shape thereby reducing the distance between pin 7 and beak element 8. The clasp is then locked. As long as the wrist remains somewhat constricted, beak element 8 will remain engaged with, and not slip out of hole 53 under normal wearing conditions and tip 83 cannot pass through hole 54.

In the locked position of the clasp, flap 9 bridges the space between the links of bracelet portions 1 and 2 and keeps out of sight the operative portions of the clasp.

To open the clasp, the bracelet is constricted to disengage tip 83 from the edge portion of hole 53 and pressure is applied in the region of the second link of bracelet portion 2 to compress the central region of curved portion 6. By compressing portion 6 the latter tends to straighten out thereby increasing the distance between pins 4 and 6 and causing beak element 8 to move out of associated holes 53 and 54 with the help of a camming action that occurs between curved ridge 81 and the corresponding edge of hole 54.

The opening of the clasp is aided by lifting flap 9 as by engaging a finger nail under front edge 10. To enable this, flap 9 is provided with lugs along its rear edge 11 that bear against portion 6 to prevent flap 9 from pivoting beyond a certain point when being lifted, preferably the position shown in FIG. 6 to prevent it from flapping when the clasp is locked.

Portions 51 and 52 and beak element 8 may be made of precious metals, or of base metals hardened by alloying or quenching, preferably so as to have a Vickers hardness of at least 140 such as to be glossy and for the surfaces that are in sliding contact to remain glossy.

I claim:

1. An extensible clasp for use with a flexible wristlet, comprising first and second elongated portions, hinge means for connecting to each other one end of said portions and means at the opposite end of said portions for pivotally connecting said portions to portions of said wristlet, said first portion being provided near its opposite end with a projecting locking element having a transverse recess therein and said second portion having first and second parts mounted for longitudinal sliding motion one relatively to the other, said first part being connected to said first portion by said hinge means and being formed with a hole at a distance from said hinge means substantially equal to the distance separating said hinge means from the locking element, and said second part being formed along the length thereof with a plurality of holes each able selectively to be brought into alignment with the hole in said first part by relative sliding motion of said first and second parts to enable the locking element to extend therethrough upon closure of the clasp, said recess being engageable with an edge portion of the hole through which it extends in said second part to lock the clasp once closed.

2. A clasp as in claim 1, further comprising a flap pivotally mounted at the opposite end of said first portion for bridging the region of said clasp, when closed, between the means provided at the opposite end of said first and second portions and for facilitating the opening of the clasp.

3. A clasp as in claim 1, wherein said second part has folded edges slidably engaging edges of said first part.

4. A clasp as in claim 1, wherein said first and second parts and the locking element are made of materials having a Vickers hardness of at least 140.

5. A clasp as in claim 1, wherein the locking element is beak shaped and has along the side thereof remote from said hinge means a ridge curving towards said hinge means, and has formed across the side thereof nearest said hinge means said recess.

6. A clasp as in claim 1, wherein the recess has a surface remote from said first portion that diverges from the part of said first portion adjacent the locking element.

7. A clasp as in claim 2, wherein the flap is provided along its pivotal mounting at the opposite end of said first portion with abutment means arranged to cooperate with the outside of said first portion for preventing pivotal movement of the flap away from said second part in the closed condition of the clasp.

8. A clasp as in claim 1, wherein said first portion is resilient and curved and said locking element is provided on the concave side of said first portion.

* * * * *